US010814386B2

(12) United States Patent
Haidar

(10) Patent No.: US 10,814,386 B2
(45) Date of Patent: Oct. 27, 2020

(54) COATING PROCESS AND COATED MATERIALS

(71) Applicant: D-BLOCK COATING PTY LTD, Kograh, NSW (AU)

(72) Inventor: Jawad Haidar, Bexley (AU)

(73) Assignee: D-Block Coating PTY LTD (AU)

( * ) Notice: Subject to any disclaimer, the term of this patent is extended or adjusted under 35 U.S.C. 154(b) by 0 days.

(21) Appl. No.: 16/312,239

(22) PCT Filed: Jun. 20, 2017

(86) PCT No.: PCT/AU2017/050620
§ 371 (c)(1),
(2) Date: Dec. 20, 2018

(87) PCT Pub. No.: WO2017/219077
PCT Pub. Date: Dec. 28, 2017

(65) Prior Publication Data

US 2019/0201974 A1 Jul. 4, 2019

(30) Foreign Application Priority Data

Jun. 20, 2016 (AU) ..... 2016902409

(51) Int. Cl.
*B22F 1/02* (2006.01)
*C23C 20/04* (2006.01)
(Continued)

(52) U.S. Cl.
CPC ..... *B22F 1/025* (2013.01); *C23C 18/08* (2013.01); *C23C 20/04* (2013.01); *C23C 24/087* (2013.01);
(Continued)

(58) Field of Classification Search
CPC ..... B22F 1/025; B22F 2999/00; C23C 18/08; C23C 20/04; C23C 24/087; C23C 24/106
See application file for complete search history.

(56) References Cited

U.S. PATENT DOCUMENTS 3,091,517 A * 5/1963 Short ..... C01B 33/02 423/342
4,399,167 A 8/1983 Pipkin
(Continued)

FOREIGN PATENT DOCUMENTS

EP 1 670 961 B1 7/2010
JP 54-145089 A 11/1979
(Continued)

OTHER PUBLICATIONS

Pierson, H. O. (1999). Handbook of chemical vapor deposition: principles, technology and applications. William Andrew (Year: 1999).*
(Continued)

*Primary Examiner* — Anthony J Zimmer
*Assistant Examiner* — Ricardo D Morales
(74) *Attorney, Agent, or Firm* — Cahn & Samuels, LLP

(57) ABSTRACT

The present invention relates to a method and an apparatus for coating large area solid substrates with metal based alloys or compounds by contacting the substrate surface with an unoxidised metal powders formed by in situ reaction of a metal halide and a reducing agent. The method is suitable for coating large area substrates such as flakes, powder, beads, and fibres with metal based alloys or compounds starting from low-cost chemicals such as metal chlorides. The method is particularly suited for production of substrates coated with metals, alloys and compounds based on Zn, Sn, Ag, Co, V, Ni, Cr, Fe, Cu, Pt, Pd, Ta, Nb, Rh, Ru, Mo, Os, Re and W.

21 Claims, 4 Drawing Sheets

(51) Int. Cl.

| | |
|---|---|
| ***C23C 18/08*** | (2006.01) |
| ***C23C 24/08*** | (2006.01) |
| ***C23C 24/10*** | (2006.01) |

(52) U.S. Cl.
CPC ..... *C23C 24/106* (2013.01); *B22F 2999/00* (2013.01)

(56) References Cited

U.S. PATENT DOCUMENTS

| | | | | |
|---|---|---|---|---|
| 4,803,127 | A * | 2/1989 | Hakim | C23C 16/32 427/249.17 |
| 5,171,734 | A | 12/1992 | Sanjurjo et al. | |
| 5,227,195 | A | 7/1993 | Sanjurjo | |
| 5,460,642 | A * | 10/1995 | Leland | C22B 5/04 266/168 |
| 5,540,769 | A | 7/1996 | Franz et al. | |
| 5,756,207 | A * | 5/1998 | Clough | C04B 35/62847 428/375 |
| 5,855,678 | A | 1/1999 | Sanjurjo et al. | |
| 6,203,768 | B1 | 3/2001 | McCormick et al. | |
| 6,241,858 | B1 | 6/2001 | Phillips et al. | |
| 6,416,721 | B1 | 7/2002 | Sanjurjo et al. | |
| 6,676,741 | B2 | 1/2004 | Phillips et al. | |
| 6,680,135 | B2 | 1/2004 | Boire et al. | |
| 6,933,048 | B2 | 8/2005 | Phillips et al. | |
| 7,559,969 | B2 * | 7/2009 | Sanjurjo | C22B 5/12 75/359 |
| 2008/0240970 | A1 * | 10/2008 | Eto | C21D 6/004 420/84 |
| 2010/0047554 | A1 | 2/2010 | Rajala et al. | |
| 2011/0052803 | A1 | 3/2011 | Bao et al. | |
| 2015/0275332 | A1 | 10/2015 | Haidar | |

FOREIGN PATENT DOCUMENTS

| | | | |
|---|---|---|---|
| JP | 57-43955 | B2 | 9/1982 |
| JP | 3-94078 | A | 4/1991 |
| JP | 11-236631 | A | 8/1999 |
| JP | 3358810 | B2 | 10/2002 |
| JP | 3872513 | B2 | 10/2006 |
| JP | 2010-510152 | A | 4/2010 |
| SU | 1759561 | A1 | 9/1992 |
| WO | 97/07917 | A1 | 3/1997 |

OTHER PUBLICATIONS

Pierson ("Handbook of chemical vapor deposition: principles, technology and applications." William Andrew. 1999) (Year: 1999).*

Australian Patent Office, International Preliminary Report on Patentability for PCT Application No. PCT/AU2017/050620, dated Aug. 22, 2018.

Liu, X, et al., Abstract for "Low-Temperature Preparation of Titanium Carbide Coatings on Graphite Flakes from Molten Salts," Journal of American Ceramic Society, Jan. 17, 2008, vol. 91, No. 2, pp. 667-670.

Gutmanas, E.Y., et al., "Coating of non-oxide ceramics by interaction with metal powders," Materials Science and Engineering, A157, 1992, pp. 233-241.

Serp, P., et al., "Chemical Vapor Deposition Methods for the Controlled Preparation of Supported Catalytic Materials," Chemical Reviews, Aug. 3, 2002, vol. 102, No. 9, pp. 3085-3128.

Yin, Xiaowei, et al., "Formation of titanium carbide on via powder immersion reaction assisted coating," Materials Science and Engineering, A396, 2005, pp. 107-114.

Industrial Property Cooperation Center, Japan Patent Office, Search Report by Registered Search Organization in Pat. App. No. 2019-518340, dated Oct. 29, 2019, pp. 1-18.

European Patent Office, English Abstract of JPS54145089 A, printed on Feb. 21, 2020, p. 1.

European Patent Office, English Abstract of JPH03094078 A, printed on Feb. 21, 2020, p. 1.

European Patent Office, English Abstract of JPH11236631 A, printed on Feb. 21, 2020, p. 1.

European Patent Office, extended European search report in Pat. App. No. 17814322.8, dated Jun. 12, 2019, pp. 1-9.

* cited by examiner

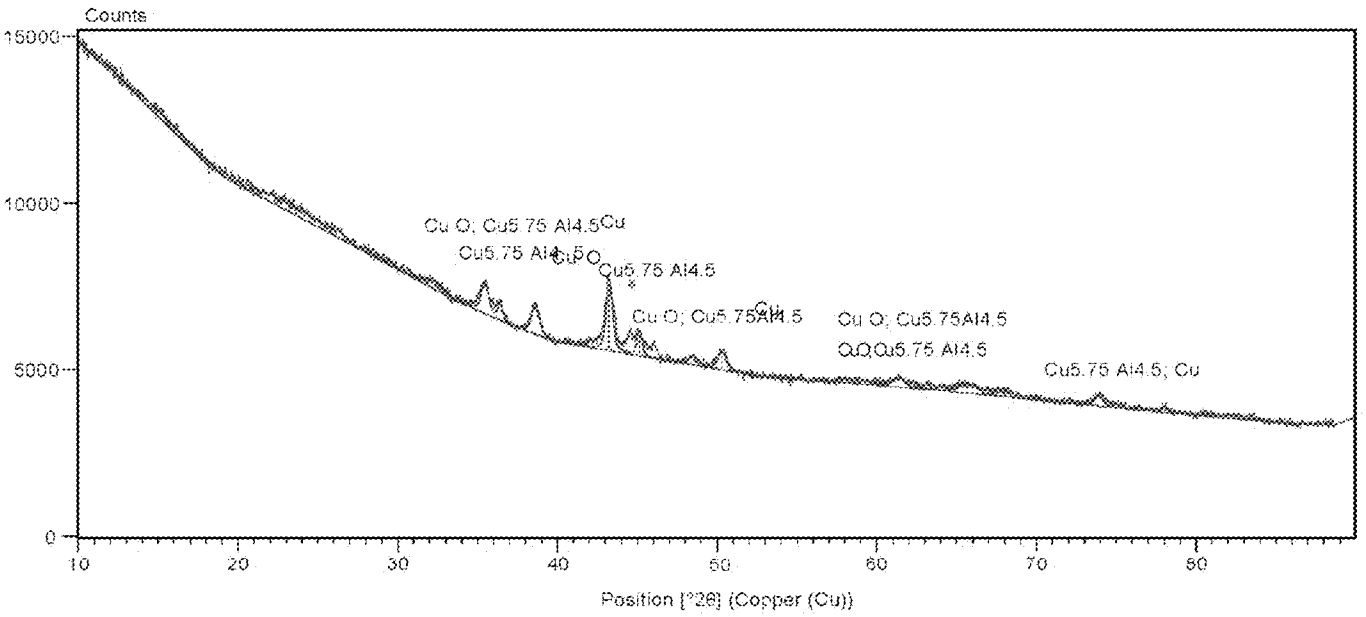
Figure 2: Cu

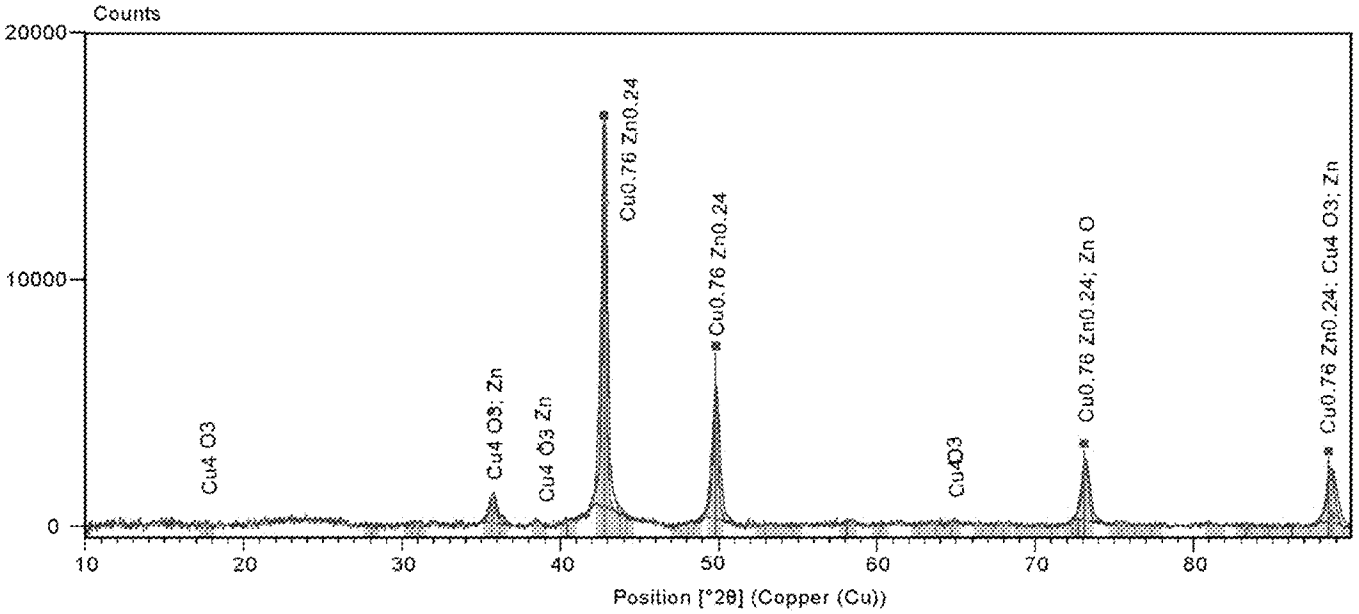
Figure 3:Cu-Zn

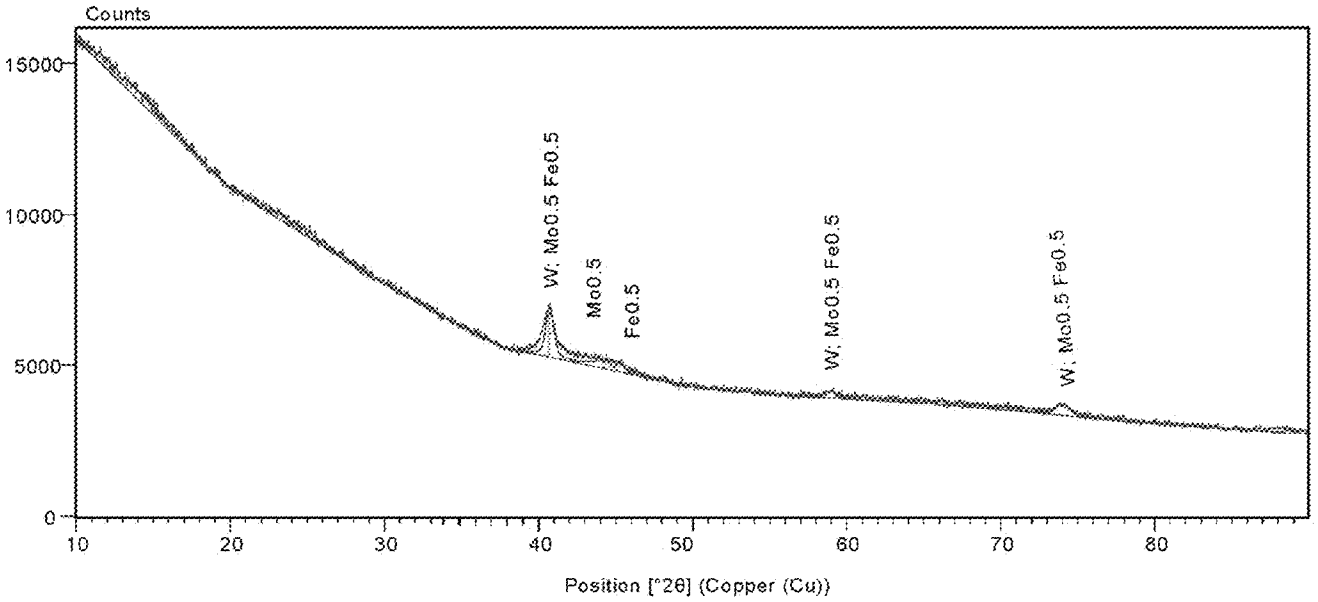
Figure 4:FeMoW

COATING PROCESS AND COATED MATERIALS

FIELD OF THE INVENTION

The present invention relates to a method for coating solid objects and large area particulate substrates with metallic alloys and compounds.

BACKGROUND OF THE INVENTION

Coated flakes and powders are used in applications such as for corrosion protection, paint, cosmetics, architectural and decorative use, and functional materials and catalysis. Processes to form coatings on large area substrates include physical vapour deposition (PVD), chemical vapour deposition (CVD), electroplating and powder immersion reaction assisted coating (PIRAC).

PVD processes usually require low pressure operation and involve use of metallic precursors, and are generally difficult to adapt for coating powders or flakes. An example of PVD coating of powder can be found in U.S. Pat. Nos. 6,241,858 and 6,676,741, describing a magnetron sputtering process for coating powdery samples to produce metallic pigments.

CVD involves reacting precursor materials, usually organometallics, with a reactive gas on the surface of a substrate resulting in a layer of materials deposited on the surface and forming a coating (P. Serp and P. Kalck and R Feurer *Chem. Rev.* 2002, vol 102, 3085-3128). For coating large area substrates, CVD processes include use of fluidised bed technology wherein gaseous precursors are processed through a fluidised substrate bed. Examples of CVD processes for deposition of Si and Ti can be found in U.S. Pat. Nos. 4,803,127, 5,194,514, 5,171,734, 5,227,195, 5,855,678 and 6,416,721. These patents are based on gas-phase reduction of halide compounds leading to intermediate unstable compounds followed by disproportionation, decomposition and/or reduction with reactive gases. Gas phase processes have the disadvantage of delicate operation requirements such as the need to evaporate the precursor materials and to obtain proper control over gas dynamics within the reactor.

For powders or flakes, PVD and CVD are usually expensive, and they tend to be practical only for up-market applications in metallic paints and cosmetics. This expense of preparation limits wide use of these materials, even though for most applications (e.g. automotive paints), coated flakes are superior to metallic Al flakes, which are currently the main metallic pigment used in the auto paint industry.

Electroplating has limitations on the type of materials that can be used and is only suitable for a limited number of metals. Usually, electroplating is inadequate for coatings based on alloys, and has significant environmental disadvantages.

PIRAC is usually used to metallise ceramic substrates; description of PIRAC can be found in the literature (e.g. (i) Gutmanas and Gotman, Materials Science and Engineering, A/57 (1992) 233-241 and (ii) Xiaowei Yin et al., Materials Science and Engineering A 396 (2005) 107-114). Per this method, a ceramic substrate is immersed in a metallic powder and heated at temperatures above 800° C. to cause the substrate surface to react with the powder forming an intermediate compound on the substrate surface. For example, $Si_3N_4$ flakes are immersed in a titanium powder bed and heated at temperatures above 850° C. to form a coating of $Ti_5Si_3$ and titanium nitride.

Large area powdered substrates coated with oxides are used in applications including catalysis (supported catalysts) and paint (interference and pearlescent pigments). Existing technologies for producing such materials include the use of PVD and CVD for forming layered structures to obtain the required effects. As mentioned before, such methods are usually expensive. Examples of processes for applications in the pigment industry can be found in U.S. Pat. Nos. 5,540,769, 6,680,135 and 6,933,048.

For supported catalysts, a comprehensive review of CVD techniques for production of coatings on solid support as applied to supported catalysis can be found in (Sep et al., Chem. Rev. 2002 vol 102, 3085-128). Per Sep et al., CVD processes using organometallic precursors are most popular and there exists a number of commercial processes for depositing metals such as Ni, C, Mo, and W starting from carbonyls. Wet chemistry is also used to produce supported catalysts based on metal oxides and this is usually done by depositing a coating on the substrate from a liquid solution followed by calcination at high temperatures. Wet chemistry is limited in its ability to control the phase and the composition of the materials obtained and is usually driven by equilibrium dynamics.

Large area substrates with metallic coatings are valuable materials with desirable properties for use in large scale industry including plastic additives, chemical and automotive, but are difficult and expensive to prepare. Often, equilibrium chemistry limits the range of materials that can be obtained and the expense of preparation limits their wide use. It is desirable to develop a low-cost process for coating of large area substrates. Such a process would be particularly desirable if it was capable of both overcoming environmental and cost disadvantages of existing technologies and allowing for production of a wide range of metal-based coatings on a wide range of substrates.

SUMMARY OF THE INVENTION

Herein:

- the terms "coating metal" and "$M_c$" refer to any one or more metals comprising Zn, Sn, Ag, Co, V, Ni, Cr, Fe, Cu, Pt, Pd, Ta, Nb, Rh, Ru, Mo, Os, Re and W,
- the term "coating alloy" refers to any alloy, compound or a composite material comprising 10% or more by weight total of the coating metals,
- the term "particulate substrate" or "large area substrate" refers to a substrate in the form of powder, flakes, beads, fibres, particulates, or a large number of small objects with a large surface area (e.g. washers, screws, fasteners . . . ). The substrate preferably has an average grain size in at least one dimension of less than 10 mm, more preferably less than 5 mm, 1 mm or 500 microns,
- the terms "nanopowder" and "nanopowders" refer to powders comprising metallic $M_c$-based species and/or $M_c$ halide species, wherein the powder has a component with an average grain size less than 1 micron and preferably less than 100 nanometers and more preferably less than 1 nanometer. Preferably the said component is more than 1 weight % and more preferably more than 25%, 50% or 80% of the powder,
- the terms "uncoated powder" or "uncoated nanopowder" refer to metal powder/nanopowder based on the coating metals where the surface of the powder grains is substantially unoxidised.

Reference to a component being "based on" for example the coating metal or alloy or on Al as a reducing agent refer to the component comprising at least 10%, more preferably at least 50%, of the nominated constituent.

One form of the present invention provides a method for forming metallic coatings on a particulate substrate through reacting the substrate surface with a mixture comprising uncoated nanopowder and metal halides both based on Zn, Sn, Ag, Co, V, Ni, Cr, Fe, Cu, Pt, Pd, Ta, Nb, Rh, Ru, Mo, Os, Re and W.

The novel method is termed "uncoated nanopowder immersion reaction assisted coating" and hereinafter referred to as UNIRAC.

Preferred forms of the inventive method aim to achieve significant reduction in the temperature required by PIRAC to form the coating and expand the range of substrate materials and coatings that can be produced.

One form of the invention provides a method for forming metal-based coatings on a particulate substrate, including:

a) Mixing the particulate substrate with an uncoated metal-based powder formed by contacting a powder comprising a halide or sub-halide of one or more Zn, Sn, Ag, Co, V, Ni, Cr, Fe, Cu, Pt, Pd, Ta, Nb, Rh, Ru, Mo, Os, Re and W with a reducing agent; and b) Heating to produce a coating on said particulate substrate.

The mixing may occur concurrently with the formation of the uncoated metal-based powder.

The reducing agent is preferably selected from one or more of Na, K, Cal, Mg, or Al, and the coating metal halide may be selected from chlorides, fluorides, bromides or iodides In accordance with a first example aspect, there is provided a method for forming a coating on a particulate substrate, wherein the substrate surface is reacted with a mixture comprising metallic nanopowder and metal halides to produce a metallic coating on the substrate.

The mixture may also include reducing agents such as Al. Preferably the metallic nanopowder is produced in-situ by exothermically reacting metal halides with reducing agents to produce an intermediate product including uncoated nanopowders and residual metal halides. The reducing agent may be gaseous such as $H_2$ or a solid powder such as alkali metals, but preferably includes Na, K, Ca, Mg, or Al, and more preferably Al.

The coating is based on alloys or compounds of the metals Zn, Sn, Ag, Co, V, Ni, Cr, Fe, Cu, Pt, Pd, Ta, Nb, Rh, Ru, Mo, Os, Re and W, and can include any number of coating additives. Coating additives can be introduced through precursors comprising the required elements; hereinafter, the term "coating additives" and the symbol "$M_a$" are intended to mean any number of elements or compounds based on O, N, S, P, C, B, Si. The symbol "$M_z$" refers to precursor chemicals for the coating additives $M_a$.

The substrate can be comprise small objects, preferably less than 10 mm, and more preferably less than 5 mm, in size in at least one dimension. The substrate can be conducting or a dielectric and may be made of stable or reactive compounds; examples of suitable substrates include particulates based on glass, mica, dielectric materials, graphite, carbon fibre, metal oxides, metallic powders, and metallic materials.

In accordance with a second example aspect, there is provided a stepwise method for coating particulate substrates, wherein metal halides are partially reacted in a first step with a reducing agent to produce an intermediate product including metallic nanopowders and metal halides; the nanopowder is uncoated with its grain surface substantially free of oxygen and has a component with a mean particle size less than 1 micron and preferably less than 100 nm; preferably the said component is more than 1 weight % and more preferably more than 25%, 50% or 80% of the powder. In a second step the intermediate mixture is heated with a large area substrate, $S_b$, at temperatures below 900° C. to induce reactions with the substrate leading to formation of a metallic coating on the substrate surface.

In a third example aspect, there is provided a method for forming a coating on a particulate substrate, wherein a substrate is reacted together with a mixture of metal halides and a reducing agent based on Al. The starting reducible precursor materials may include at least one solid metal halide powder and the reducing agent is in a powder form. The amount of reducing agent can be between 0% and 200% of the amount needed to reduce the halides to their elemental metal base. For the method of this aspect, the by-products are continuously separated from the coated substrate.

The method can be operated in a batch mode, a semi-continuous mode or in a full continuous mode, and by-products are separated and removed from the reaction products, either continuously or in a batch-mode operation.

In accordance with a fourth example aspect, the present invention provides an apparatus for coating large area substrates with metal compounds, comprising:

storage containers for holding reactants under inert atmosphere; and accessories for mixing, milling and feeding powders under inert atmosphere; and a reactor vessel capable of operating at temperatures up to 900° C. and with pressures between 0.001 atm and 1.2 atm, for processing solid metal halides, metallic powders, and substrate powders; and a condenser and collection vessels for collecting and holding and storing corrosive by-products and coated substrate products; and a scrubbing unit to clean processing gases from any residual halides.

Typically, the apparatus of this aspect of the invention is suitable for implementing the method of any of the aspects and embodiments of the invention described herein.

The UNIRAC method described here provides a novel technique for forming coating on a large area substrate. The method is based on reacting a substrate surface with a mixture including uncoated nanopowder and metal halides to induce reactions leading to formation of metallic coating on the substrate surface. The substrate is preferably in the form of a powder, flakes, fibres, particulates, or many small objects. The coating is based on one or more coating metals and can include any number of additive elements.

The method is understood to provide significant improvements upon the prior art PIRAC technique due to the enhanced reactivity of uncoated nanopowders/powders resulting from the small particle size, high surface energy and the absence of oxide coating on the nanopowder/powder particulate surface. Also, there are the additional effects of both catalytic deposition induced by the catalytic effects of the substrate, and chemical reactions between the substrate and the reactants, further helping generate metallic species and enhance the coating process. In a preferred embodiment, the method includes procedures for producing the required intermediate mixture comprising nanopowders and metal halides. The nanopowder is defined as having a component with particulates consisting of sub-micron particles or agglomerates.

The oxygen free surface together with the high surface energy of the nano-sized grains of the uncoated nanopowder are believed to result in significant reductions in the threshold temperature required to trigger reactions between the substrate and the powder. The present approach aims to allow for low cost production of a wide range of coatings and compounds of commercial interest.

In one embodiment, an intermediate mixture of uncoated nanopowders and residual metal halides is produced by any available means and then mixed with a substrate powder and heated at temperatures between 200° C. and 900° C. to induce formation of metallic species on the substrate surface. In one form of this embodiment, the intermediate mixture is produced through gas phase reduction of the halides; for example, a reducing hydrogen gas may be used to reduce metal halides at elevated temperatures.

In a further embodiment, the intermediate mixture is produced in-situ at temperatures between 100° C. and 500° C. and at pressures between 0.01 mbar and 1.2 bar. The starting precursor materials may include at least one solid metal halide together with chemicals containing the coating additives.

In one example embodiment, the reducing alloy is a powder based on Na, K, Ca, or Mg, and then, the method includes the steps of:

reacting a coating metal halides with the reducing alloy to produce an intermediate mixture including nanopowders and residual halides;

heating the intermediate mixture with a substrate powder to form a coating; and separating the reducing metal halide by-products from the coated substrate product.

In one embodiment of the method, the halide is a chloride, the reducing alloy is based on Al and the by-product is aluminium chloride; the terms Al and Al alloy refer to alloys based on Al including pure aluminium and the terms aluminium chloride(s) and $AlCl_3$ are used to describe all Al—Cl compounds.

For the discussion presented in the rest of this disclosure, we will illustrate the various embodiments and processing steps and outline procedures for processing the reactants and produce the coating using an example where the starting reactants are metal chlorides and a reducing Al alloy. It will be apparent to a person skilled in the art that when other halides and reducing alloys are used, appropriate variations can be included to handle the corresponding by-product halides. In particular, the required variations are minimal for embodiments where the by-product halides have a low sublimation/boiling temperature comparable to $AlCl_3$ (e.g. by-products of $AlBr_3$ and $AlI_3$ for embodiments starting from metal bromides and metal iodides and a reducing alloy based on Al).

In one preferred embodiment, the present invention provides a method for coating large area substrates, comprising the steps of:

Reduction Stage (nanopowder production phase): reacting a reducible mixture of coating metal chlorides, $M_cCl_x$, with a reducing Al alloy in the presence of a large area substrate, and optionally including coating additives ($M_z$) to produce a reactant mixture comprising $M_c$-$M_cCl_y$—Al-$M_z$-$S_b$; the Reduction Stage processing is carried out at a pressure between 0.01 mbar and 1.2 bar and preferably at temperatures between 25° C. and 600° C. and more preferably at temperatures between 160° C. and 500° C.; and the Al alloy is preferably in a fine powder form; and Coating Stage (substrate coating phase): continuously mixing, stirring, heating, and reacting the resulting intermediate products from the Reduction Stage, including $M_c$-$M_cCl_y$—Al-$M_z$-$S_b$, at a pressure between 0.01 mbar and 1.2 bar and at temperatures between 160° C. and $T_{max}$ to produce metallic coating on the large area substrate; $T_{max}$ is preferably below 900° C. and more preferably below 800° C. and still more preferably below 700° C. and yet more preferably below 600° C.; and the reaction by-products comprising aluminium chloride are removed and condensed away from the coated substrate; and collecting the resulting products, and as necessary separating the coated substrate from residual un-reacted materials and washing and drying the coated substrate.

In an embodiment according to a third aspect, the method comprises the steps of:

heating a mixture comprising one or more coating metal chlorides, a large area substrate and Al at temperatures between $T_0$ above 180° C. and $T_{max}$ to produce intermediates comprising metallic $M_c$-based species in a nanopowder form and then induce physical or chemical reactions between the $M_c$-Al species and the substrate to produce a coating on the substrate surface; $T_{max}$ is preferably below 900° C. and more preferably below 800° C. and still more preferably below 700° C. and yet still more preferably below 600° C.; and collecting the resulting products, and as necessary separating the coated substrate from residual un-reacted materials and washing and drying coated substrate.

Preferably, the coating is based on one or more of the coating metals and the starting reducible precursors are based on the corresponding chlorides $ZnCl_2$, $SnCl_2$, AgCl, $CoCl_2$, $VCl_{(2,3)}$, $NiCl_2$, $CrCl_{(2,3)}$, $FeCl_{(2,3)}$, $CuCl_{(1,2)}$, $PtCl_{(4,3,2)}$, $PdCl_2$, $TaCl_{(4,5)}$, $NbCl_5$, $RhCl_3$, $RuCl_3$, $MoCl_5$, $OsCl_{(2,3,4)}$, $ReCl_3$ and $WCl_{(4,5,6)}$. It is preferable that the starting chlorides have a decomposition or sublimation temperature higher than the sublimation temperature of the aluminium chloride.

Coating additives can be introduced through various solid or gaseous precursors comprising the required coating additives. Preferably, the coating additive precursors are based on chlorides. However, metallic powders can be included as precursor materials for the coating additives and the precursor powders would then react with the substrate and with the coating metals in the reactants to produce a coating compound.

The amount of the reducing Al alloy used depends on the starting precursor materials and the required composition of the end products and can be below the stoichiometric amount needed to reduce all the reducible starting precursor chemicals. Preferably, the amount of Al is between 50% and 200% of the amount required to reduce all the chlorine in the starting reducible precursor chemicals $M_cCl_x$ to their elemental metal base $M_c$. However, in some preferred embodiments wherein the substrate is reactive or its composition includes elements that are more reactive than Al, the amount of Al can be below 50% and down to 0.01% of the amount required to reduce all the starting $M_cCl_x$ to $M_c$.

The coating is composed of an alloy or a compound based on the coating metals and can include any number of coating additives. A person ordinarily skilled in the art of the invention would appreciate that the end-product may contain residual Al impurities, and in all embodiments, the substrate coating can include Al at levels between 0% and 50 weight (wt) %.

The substrate can be conducting or a dielectric, and preferably, in the form of a powder or flakes or a multitude of small objects, and a product of said method is a substrate coated with a $M_c$-based or alloy. The substrate can be made of a material with a low reactivity such as oxides, nitrides or other stable compounds (e.g. glass, metal oxides . . . ).

Examples of suitable substrates include glass flakes, glass beads, glass powder, mica flakes, talc powder, dielectric flakes, carbon fibre, beads and powder, and steel balls, or other small object with large areas (e.g. fastening accessories, screws, washers, bolts . . . ). In other embodiment, the substrate is made of materials based on metallic or semi metallic elements; e.g. transition metals, graphite, silicon and boron or mixtures thereof.

Preferably, the substrate is mixed with the reducible solid coating metal chlorides or the reducing Al alloy, prior to reacting with the remaining reactant (reducing Al alloy or reducible coating metal chlorides). Preferably, during processing in both the Reduction Stage and the Coating Stage, the substrate and the solid reactants including the coating metal chlorides and the reducing Al alloy are continuously mixed to maximise contact between the substrate surface and the solid reactants and improve coating of the substrate surface.

The maximum processing temperature $T_{max}$ is determined by factors including the kinetic barrier of reactions between the precursor materials and the reducing Al alloy and the adhesion of the coating to the substrate and preferably this maximum is below the melting temperature of the substrate. However, the maximum temperature can exceed the melting temperature of the substrate if the deposited materials are required to diffuse through the bulk of the substrate. In all preferred embodiments, the present invention is intended for operation at a maximum temperature around 900° C. By way of illustration only, if tantalum was the coating material and the substrate was made of borosilicate glass beads or borosilicate glass flakes, and for processing at 1 atmosphere, then $T_{max}$ can be less than 600° C. For coating on a mica substrate, $T_{max}$ can be set up to 700° C. For coating on graphite powder, $T_{max}$ can be up to 850° C. For coating on a soda-glass substrate, $T_{max}$ can be up to 650° C. but is preferably below 550° C.

In all embodiments, the maximum processing temperature of reactants including the substrate is preferably below the melting temperature or the decomposition temperature of the substrate.

In one embodiment suitable for processing chlorides with a low boiling/sublimation temperature below 400° C., suitable for processing $TaCl_5$, $NbCl_5$, $MoCl_5$, $WCl_4$, $FeCl_3$, $VCl_4$ and $SnCl_4$, the method is a stepwise method, wherein in a first step, coating metal chlorides are first reduced with or without the large area substrate at temperatures between $T_0$ and $T_1$ in a batch mode, semi batch mode or fully continuous mode using any suitable reduction method to produce intermediate products including subchlorides with a higher boiling/sublimation temperature. Then, in a second step, the resulting intermediate products are processed according to any of the foregoing or forthcoming embodiments to produce a coated substrate.

Reactions between the coating metal chlorides and Al are exothermic. Therefore, it is important to carry out the method gradually, and in a preferred embodiment, the present invention provides a method for coating of large area substrates, comprising the steps of:

providing a first reactant including reducible precursor chemicals with at least one solid coating metal chloride; and providing a second reactant including a reducing Al alloy in a fine particulate form; the amount of Al is between 0% and 200% of the amount required to reduce $M_cCl_x$ to $M_c$; and providing precursor materials for the coating additives; and preparing a first stream of materials consisting of a mixture of the substrate and at most one of the first reactant or the second reactant; and gradually mixing and reacting the said first stream of materials including $M_cCl_y$ or the Al alloy with a second stream including the remaining reactant (Al alloy or $M_cCl_x$) at temperatures between $T_1$ higher than 160° C. and $T_{max}$ below 900° C. for periods enough to reduce all or a part of the solid coating metal chlorides and form a coating on the substrate; reactions between the starting precursor chemicals are heterogeneous and the substrate acts as a catalyst for the reaction; and condensing the resulting by-products away from the other reactants; and collecting the resulting products, and as necessary separating the coated substrate from residual un-reacted materials and washing and drying the coated substrate.

For continuous operation, the solid mixture of precursor chemicals, the substrate and the reducing Al alloy are processed at temperatures, preferably increasing from a temperature $T_1$ at the point where the mixture enters the reactor to a temperature $T_{max}$ below 900° C., before the resulting products are cooled and discharged out of the reactor. Preferably, $T_1$ is above 160° C. and more preferably above 180° C., and $T_{max}$ is less than 900° C. and preferably below the melting or decomposition temperature of the substrate. In one preferred embodiment according to this continuous operation scheme, the mixture of $M_cCl_x$—$S_b$—Al is first heated at temperatures from $T_1$ above 160° C. to a temperature $T_2$ below 500° C. for times long enough to reduce a part of the reducible precursor chemicals and form a nanopowder. Then, the resulting reactants are heated at temperatures starting from $T_3$ higher than 400° C. to a maximum temperature $T_{max}$ below 900° C. and preferably below the decomposition or melting temperature of the substrate. The resulting products are then cooled and discharged for further processing.

In any of the embodiments, the process may be carried out in an inert gas, preferably Ar or He. In one embodiment, the gas stream consists of a mixture of Ar and reactive components such as $O_2$ and $N_2$. For example, when $O_2$ is included in the gas stream, the coating can comprise metal oxides.

In one embodiment, a stream of inert gas is arranged to flow in a direction away from the reactants and the solid reaction products.

In one embodiment for batch mode operation, the reactants and the substrate are fed gradually or together to a reactor set at temperature above 200° C., and then the reactants are heated and stirred continuously until the coating process is complete.

In one embodiment, the precursor materials include reactive additives and then the coating would include compounds based on the coating metals and the additives. For example, for additives of carbon, silicon, boron, oxygen and nitrogen, the coating can comprise carbides, silicides, borides, oxides and nitrides respectively.

In one embodiment, the method comprises an additional step wherein materials obtained at the end of the coating process are reacted with gaseous reactants at temperatures between 25° C. and 850° C. Gaseous reactants include gases containing reactive elements such as oxygen, nitrogen, boron and carbon. For example, an $M_c$ coated substrate may be heated in a stream of oxygen to produce a $M_c$-based oxide. Alternatively, coating of metal oxides on glass beads can be achieved by carrying out the reaction in a stream of argon containing a certain concentration of oxygen.

For embodiments involving use of reactive gases, preferably, the reactive gases are introduced in the Coating Stage, and more preferably after the substrate has been coated.

In one example embodiment, the coating metal chlorides and the reducing Al alloy are separately mixed with $AlCl_3$ before carrying out the reactions according to any of the foregoing or following embodiments. The mixing step is intended to increase the dilution of the reactants and increase contact surface area with the substrate while at the same time avoid any potential unintended reaction occurring prior to mixing with the substrate. The amount of $AlCl_3$ can be between 10% and 500% of the volume of the substrate.

In one preferred embodiment, the volume of the $AlCl_3$ is approximately equivalent to the volume of the substrate. In one embodiment, only the coating metal chlorides are mixed with $AlCl_3$. In another form of this embodiment, only the reducing alloy is mixed with $AlCl_3$. In a third form, both the coating metal chlorides and the reducing alloy are both separately mixed with $AlCl_3$. The mixing step can be carried out using any suitable means.

In one embodiment, the step of mixing the metal chlorides with $AlCl_3$ is done by co-milling.

In any of the embodiments, the coating on the coated products can include metallic particulates.

In one embodiment, the method is used for preparation of multilayered compounds using pre-coated substrates as a starting coating platform. For example, in a first step the method can be used to deposit a first coating onto a substrate and then the resulting coated substrate is used again in a second step as a coating platform to deposit a second layer of materials. For example, glass beads can be used in a primary step to deposit a layer containing vanadium and then the resulting product is used as a platform to deposit a second layer containing chromium.

In one embodiment, all or a part of the substrate can react with the coating to produce a product with a coating of intermetallics, alloys or compounds based on the substrate materials and the coating materials.

In one embodiment, the method comprises reacting a part or all of the substrate with the coating metal to produce a product of intermetallics, alloys or compounds based on the substrate materials and the coating materials. For example, when the precursor materials are $M_cCl_x$ and the substrate is a powder of graphite, then the product of said method can be a graphite powder coated with metal carbides.

In one embodiment, the substrate is reactive and coating or metallisation of the substrate is mostly due to reactions between the substrate surface and the metal chlorides; in some embodiments using reactive or partially reactive substrates such as mica for example, containing reactive elements such as potassium and Al, reactions between metal halides and the substrates can occur directly leading to deposition of coating on the surface or to incorporation of coating metals into the chemical structure of the substrate. In such embodiments, the amount of reducing alloy (e.g. Al) can be reduced substantially even down to zero as the substrate has the capacity to act as a reducing agent.

In one embodiment, the coating reacts with the substrate to form composite materials or compounds based on the substrate and the coating.

In one embodiment, the coating reacts partially with the substrate to form a coating based on the substrate and the coating.

In one embodiment, the substrate materials include silicon based chemicals and the coating includes metal silicides.

In one embodiment, the substrate is a glass powder or glass flakes and the coating includes metal silicides. In one form of this embodiment, the substrate is based on borosilicate and the coating includes compounds based on $M_c$-Si—B.

In any of the embodiments, the method can comprise the step of separating the end products of coated substrate from any residual un-reacted precursor materials and un-reacted aluminium. The method can also include the step of washing and drying the end products.

In any of the embodiments, the weight ratio of coating metal chlorides to substrate is between 1 wt % and 500 wt %, and preferably between 1 wt % and 200 wt %, and more preferably between 5 wt % and 100 wt % and more preferably between 5 wt % and 50 wt %.

In any of the embodiments, the method can be carried out at pressures between 0.01 mbar and 1.1 bar.

The present UNIRAC method differs from prior art in many aspects. The discussion presented below highlights some basic phenomena occurring within the reacting $M_c$ Al—Cl-substrate system. However, the discussion is not intended to be comprehensive and/or to limit the present invention to any theory or mechanism of action.

The method provides a single enhanced coating method with significant advantages over both CVD processing and PIRAC techniques. The method improves over related prior CVD art and PIRAC art, through its ability to reduce the processing temperature and extend the range of materials that can be used. The present approach differs from prior art in several other major aspects:

1 for in-situ production of the intermediate nanopowder mixture, the method is based on solid-solid reductions between the reducible coating metal halides (e.g. chlorides) and the reducing alloy (e.g. Al alloy);

2 combining the two processes of halide reduction and deposition/interaction with the substrate into a single heating cycle simplifies the processing steps significantly; to our knowledge this arrangement has never been employed before in a coating process; and 3 the approach allows for deposition of coating compositions (e.g. alloys) usually unobtainable under conditions prevailing in PVD and CVD;

4 no carbonyls are needed and the process produces no hazardous waste.

Al, Mg, and Na are attractive reducing agents for metal halides due of a combination of factors, including ready availability and low cost, and in addition, their halides (e.g. $AlCl_3$) do not present significant handling difficulties and they are valuable industrial chemicals.

For the present approach, coating of the substrate results from a combination of mechanisms and effects comprising:

i heterogeneous reactions taking place at the surface of the substrate and leading to deposition of elemental products directly on the substrate surface, ii formation of metallic nanoparticles and clusters followed by adhesion to the surface, iii higher reactivity of uncoated nanoparticles and the presence of active chlorides allowing the process to be carried out at temperatures significantly lower than for previous arts (i.e. PIRAC process), iv reaction of the in-situ formed metallic nanoparticles with the substrate surface, leading to formation of $M_c$-based coating, v reactions between the substrate surface and precursor materials, and vi disproportionation of unsaturated intermediate compounds on the surface of the substrate.

Discussion here refers to chlorides and Al for illustrating physical mechanisms and aspects of the technology. However, the discussion remains mostly valid for most other combinations of starting precursors and reducing alloys.

Reactions between metal chlorides and Al are heterogeneous and they tend to occur on a solid surfaces where elemental $M_c$(c) can condense. For the embodiments and procedures discussed in this invention disclosure, the substrate surface is a primary condensation surface for $M_c$(c), and as such the substrate plays an important role as a catalyst in helping generate the $M_c$-based nanopowder and metallic species and forming the coating. $M_c$(c) species generated on the substrate surface do not necessarily adhere to the surface if the temperature was below a minimum threshold adhesion temperature. For example, for a substrate of glass flakes, processing at 450° C. under 1 atm does not produce any coating, while processing at 600° C. results in metallic coating. However, localised increase in temperature of the substrate surface due to exothermic heat generation promotes adhesion of elemental $M_c$ species to the substrate surface; reactions occurring immediately adjacent to or on the substrate can increase the local temperature above the threshold adhesion temperature and then lead to the $M_c$(c) products directly adhering to the surface.

In a preferred embodiment, process conditions are arranged to maximise reactions between $M_cCl_x$ and Al taking place at the substrate surface through efficient mixing of the reactants at temperatures between 200° C. and 600° C. When reduction reactions are not taking place on the substrate surface, small nanometre (or sub-nanometer) clusters and agglomerates based on $M_c$ and $M_c$-Al can form and efficient mixing is required to bring the agglomerates into contact with the substrate before they form large particle and either become lost to the process or deteriorates the quality of the coating. Therefore, vigorous stirring of the reactants may be required to maximise contact between the various components of the mixture and optimise coating of the substrate surface.

Stirring helps bring nanoparticles and unsaturated species produced during processing into contact with the substrate and then those species can react, disproportionate and adhere to the surface and hence help improve the quality of the coating.

Also, adsorption (both chemical and physical) of elemental $M_c$ can occur on the surface of the chlorides particles leading to non-stoichiometric $M_c$-Cl macro-particles and contact of those macroparticles with a stable surface such as the substrate can lead to discharging of the elemental $M_c$ onto the stable substrate surface.

As the nanoparticles/clusters are substantially free of any oxygen coating, they tend to react considerably more effectively with the substrate surface resulting in formation of a coating at temperatures lower than would normally be required if a conventional micron size metal powder coated with an oxide layer was used—as is the case with all similar prior art (i.e. PIRAC). The effectiveness of the coating process is further enhanced by the presence of metal chlorides which tend to help breakdown the top stable surface of the substrate materials (e.g. $SiO_2$ for glass flakes, metal oxides for metal substrates . . . ). Reactions between the substrate materials and the reactants can lead to formation of an intermediate layer comprising compounds made of the coating metal and the substrate materials. Depending on the thickness of the coating, the amount of substrate materials in the coating can decrease past the intermediate layer as the thickness of the coating increases.

For embodiments discussed before centred on $M_c$-based coating, direct reactive interactions between $M_c$-based phases and the substrate can play an important role in the coating process; the substrate surface can react with other solid reactants and the resulting coating can comprise compounds based on the substrate materials and the coating materials. A key aspect of the present method is due to the enhanced ability of the $M_c$-based nanoparticles to react with the substrate leading to formation of coating based on $M_c$ and the substrate materials. As discussed before, the absence of oxygen coating on the metallic $M_c$-based nanopowder helps reduce the kinetic barrier for reactions between elemental $M_c$ and the substrate surface, allowing for formation of chemicals bonds between $M_c$ and the substrate materials at low(er) temperature. Also, the small particle size of the powder with the associated high surface energy together with the presence of active residual chlorides can have an important role in enabling the reduction of the threshold reaction temperature. The presence of residual halides (e.g. chlorides) is known to enhance transport of coating materials along the substrate surface and help breakdown the usually stable oxide coating of the substrate surface.

For some embodiments, wherein the substrate materials include elements that can reduce the starting metal chlorides, reactions between the base metal chlorides and the substrate, leading to formation of metallic phases on or as part of the substrate surface can dominate over all other reaction mechanisms. For example, for a Mica substrate with a typical composition of $KAl_3Si_3O_{10}(OH)_2$, base metal chlorides such as $CuCl_2$ can react with the Mica leading to formation of KCl together with the incorporation of metallic Cu into the substrate surface. Coating of the substrate surface according to this mechanism is claimed an integral part of the present disclosure.

It is noted that reactions between the nanopowders and the substrate are not limited to chemical reactions, and other physical interactions can lead to adhesion of elemental 114, species to the surface. For all embodiments and configurations discussed here, it is intended that the term "reaction between the substrate surface and nanopowder" include physical interactions and disproportionation reactions occurring on the substrate surface and leading to direct coating of the surface.

In some embodiments, the coating metal does not react chemically with the substrate and then the coating is entirely made of the metal/additive compounds. However, in common to embodiments of the present invention, formation of the coating is substantially promoted by the small size of the intermediate metallic particles and the absence of oxides on the surface of the particles.

It follows from the discussion that the main mechanisms likely to contribute most to the coating are due to:

i reactions between the substrate and the nanopowder; and ii direct deposition due catalytic reduction reactions and to disproportionation at the substrate surface; and iii direct reactions between the substrate and the starting metal halides (e.g. chlorides).

The first mechanism is dominant at atmospheric pressure while direct deposition gains importance at low pressures. For example, when the substrate is made of silicon based materials and the process is carried out at 600° C. in inert gas a 1 atm, $M_c$ can react with Si from the glass substrate to form a coating comprising metal silicides. In contrast, when processing is carried out at a low pressure at 450° C., the coating is mostly of pure $M_c$ and the second mechanism tends to prevail.

Disproportionation reactions can occur when the coating metal chloride has multiple valences; for example, when $M_cCl_x$ is not the highest valence chloride (e.g. for Fe where chlorides include $FeCl_2$ and $FeCl_3$, and for Ta, where chlorides include $TaCl_2$, $TaCl_3$, $TaCl_4$ and $TaCl_5$), and such reactions are usually slow. However, the rate can increase significantly under conditions of low pressures, and the method includes operation at low pressures down to 1 mbar. In particular, when disproportionation reactions are enhanced at low pressure, the end-product might contain significant residual Al impurities.

Direct reactions between the halides and the substrate are of significant importance only for reactive substrates and then they can be the dominant mechanism.

BRIEF DESCRIPTION OF THE DRAWINGS

Features and advantages of the present invention will become apparent from the following description of embodiments thereof, by way of example only, with reference to the accompanying drawings, in which:

FIG. 2 shows an XRD trace for a sample of glass flakes coated with Cu.

FIG. 3 shows an XRD trace for a sample of glass flakes coated with Cu—Zn.

FIG. 4 shows an XRD trace for a sample of glass flakes coated with Fe—Mo—W.

DESCRIPTION OF PREFERRED EMBODIMENTS

Figure 1:
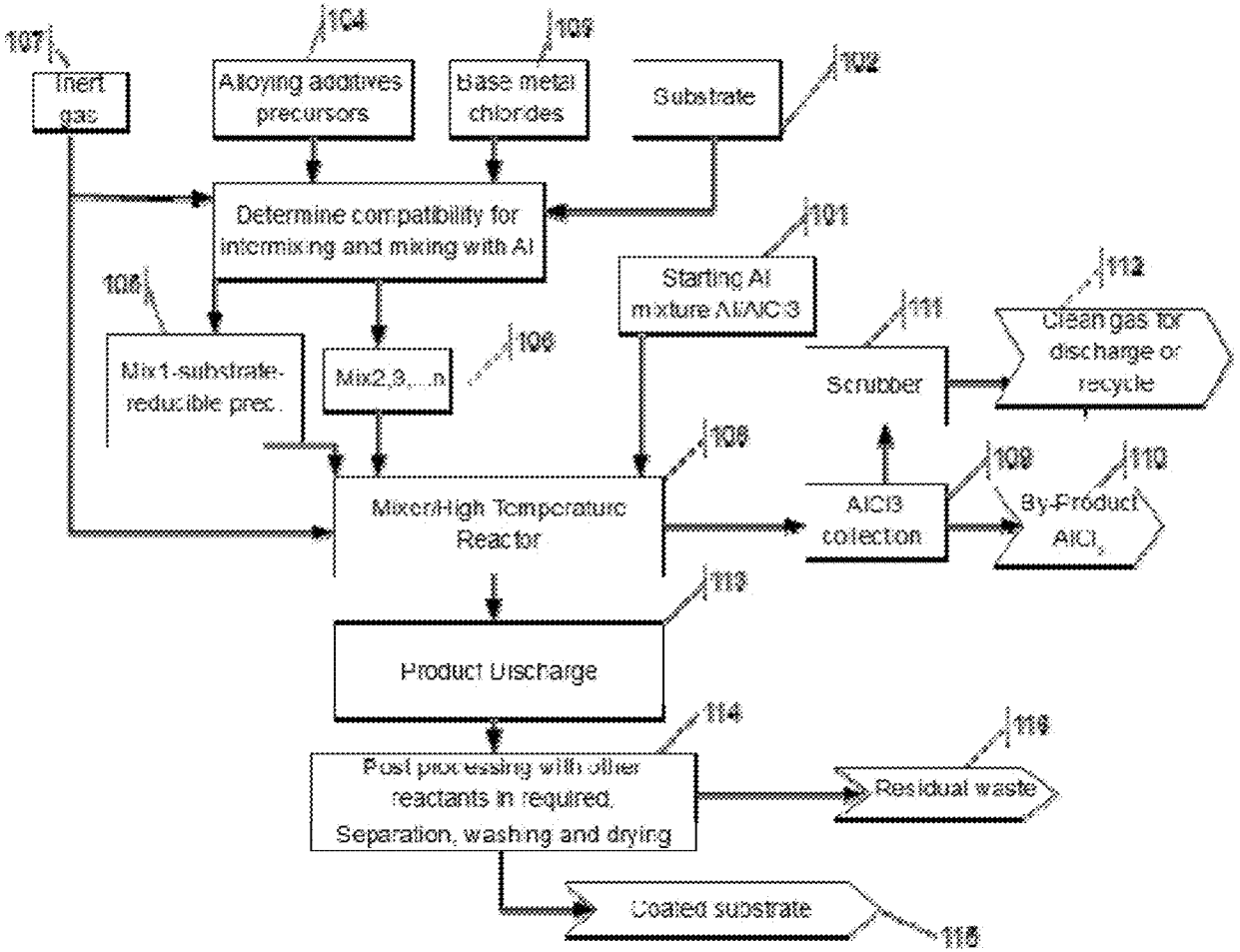
FIG. 1 shows a block diagram for one embodiment illustrating steps for coating a substrate.

FIG. 1 is a schematic diagram illustrating processing steps for one preferred embodiment for production of coated glass flakes.

In a first step (101), a fine Al alloy powder is mixed together with an $AlCl_3$ to produce a large volume Al—$AlCl_3$ mixture. Other coating additives may be added to the Al—$AlCl_3$ if required.

The substrate (102) is mixed with the coating metal chloride (103) together with other compatible coating additives (104) leading to a first mixture (Mix1) (105). The remaining coating additive precursors (104) are prepared into several mixtures (106). Mixing and preparation of the precursor materials is carried out under an inert atmosphere (107).

The reducing Al alloy (101) and mixtures (105) and (106) are fed into a premixer (not shown) and then into a reaction zone where they are mixed, stirred and reacted at temperatures between 160° C. and 800° C. (108), depending on the substrate materials and coating.

The resulting by-products (109), including aluminium chlorides, are condensed away from the solid reactants, and collected in a dedicated vessel (110). A part of the aluminium chlorides may be recycled through (101). All processing steps are preferably carried out under inert gas (e.g. Ar) and the exit of the by-product collection step, the gas is cleaned in a scrubber (111) before discharging into the atmosphere or recycling (112).

At the end of the reaction cycle (108), the solid products are discharged or moved into another reaction zone (113). If required, the products can then be reacted further with gaseous reactant for example before separating the coated substrate from residual undesired compounds and then substrate may be washed and dried (114) leading to end products (115).

Residual waste (116) is stored separately for further processing or disposal.

Materials produced using the invention described here have unique characteristics that may not be obtained using prior art methods.

The invention extends to materials made using the invention and use of the materials, without being limited by the examples provided herein by way of illustration. Specific properties include the ability to produce nanostructured coating for large area substrate of complex composition usually unachievable with conventional physical vapour deposition or chemical vapour deposition.

For example, the coating process described here can be used to produce a composite material of cobalt borides supported on graphite (or on glass flakes) where the carbon is encapsulated inside the coating. The composite graphite-Cobalt boride can then be consolidated into porous structure using conventional binding techniques. Such materials are useful for use as catalysts for several chemical processes. Other examples of materials that can be produced using the current invention include supported catalysts of Mo on alumina, Rh on activated carbon, Pt on activated carbon/dielectric powder and $V_2O_3$ supported on $TiO_2$.

A second example of the quality and use of materials produced using the current technology is in production of luxury metallic pigment for use in the automotive paint industry and in the wider pigment industry in general. There are various techniques capable of producing a limited number of metal flake pigments; however, these techniques are limited to common metals such as aluminium, and for a number of other metals, the cost can be prohibitive. For example, the present method allows for production of low cost pigment with various hues, optical properties and functional characteristics that cannot be manufactured using existing technologies. Such metallic pigments can be attractive for use in the plastics industry, automotive paint, and in general paint and architectural applications. Such pigments and their use are claimed as a part of the present invention.

The following are examples of preparation of various coating compounds in accordance with an embodiment of the present invention.

Example 1: Ni on Glass Flakes 200 mg of $NiCl_2$ powder mixed with 2.5 g of $AlCl_3$ powder.

60 mg of Ecka Al powder (4 microns) mixed with 2.5 g of $AlCl_3$.

5 g of glass flakes (average diameter of 200 microns and a thickness of 1.6 microns).

The three materials are mixed together thoroughly.

The mixture was then heated in a rotating quartz tube under argon at temperature ramping from room temperature to 600° C. in batches of 4 g for 30 minutes. The powder was then sieved to remove un-deposited products and the remaining coated flakes washed water and dried. The coated flakes have metallic appearance. Examination under an SEM and EDX shows that the surface is thoroughly coated with metallic Ni but with the presence of lumps of metallic Ni.

Example 2: Cu on Mica Flakes 1.2 g of $CuCl_2$ powder was thoroughly mixed with 3 g of $AlCl_3$ powder.

410 mg of Ecka Al powder (4 microns) was mixed with 3 g of $AlCl_3$ powder.

The $CuCl_2$—$AlCl_3$ was mixed with 5 g of Mica flakes (size 0.5-0.8 mm) and then the resulting mixture was thoroughly mixed with the Al—$AlCl_3$. The resulting reactant mixture was then heated in a rotating quartz tube at 700° C. in batches of 5.5 g for 30 minutes. Products were then sieved to eliminate fine powder and the coated flakes was then washed and dried. The end products have a shiny metallic colour.

Example 3: Won Glass Flakes 1.22 g of $WCl_6$ powder was milled with 2.5 g of $AlCl_3$ powder.

180 mg of Ecka Al powder (4 microns) was mixed with 2.5 g of $AlCl_3$ powder.

The $WCl_6$—$AlCl_3$ was mixed with 5 g of glass flakes (average diameter of 200 microns and a thickness of 1.6 microns) and then the resulting mixture was thoroughly mixed with the Al—$AlCl_3$. The resulting reactant mixture was heated in a rotating quartz tube at 575° C. in batches of 2.2 g for 30 minutes. The resulting product was then discharged, washed and dried. The flakes have a shiny deep dark grey appearance.

Example 4: Cu on Glass Flakes 1 g of $CuCl_2$ powder was milled with 2 g of $AlCl_3$ powder.

200 mg of Al powder (4 microns) was mixed with 1 g of $AlCl_3$ powder.

The starting reactants were mixed with 5 g of glass flakes (average diameter of 200 microns and a thickness of 1.6 microns) and then the resulting mixture was thoroughly mixed with the Al—$AlCl_3$ mixture. The resulting reactant mixture was heated in a rotating quartz tube at 575° C. in batches of 4 g for 20 minutes. The resulting product was then discharged, washed and dried. The flakes acquire the brown-reddish appearance copper. XRD trace for the resulting product is in FIG. 2.

Example 5: Cu—Zn on Glass Flakes 104 mg of $ZnCl_2$+318 mg of $CuCl_2$ powder was mixed with 1 g $AlCl_3$ powder.

168 mg of Ecka Al powder (4 microns) mixed with 1 g $AlCl_3$ powder.

The starting reactants were mixed with 2 g of glass flakes (average diameter of 200 microns and a thickness of 1.6 microns). The resulting mixture was heated in a rotating quartz tube at 575° C. for 30 minutes. The resulting product was then discharged, and then washed and dried. The powder has a shiny appearance. SEM analysis shows complete coverage and some occasional lumps on the surface. XRD trace for the product is in FIG. 3.

Example 6: Fe on Glass Flakes 1.3 g of $FeCl_3$ was first reduced with Al to $FeCl_2$ powder.

1 g FeCl2 was mixed with 2.5 g $AlCl_3$ powder.

200 mg of Al powder (4 microns) were mixed with 2.5 g of $AlCl_3$ powder.

The $FeCl_3$—$AlCl_3$ was mixed with 5 g of glass flakes (average diameter of 200 microns and a thickness of 1.6 microns) and then the resulting mixture was thoroughly mixed with the Al—$AlCl_3$. The resulting reactant mixture was then heated in a rotating quartz tube at 575° C. in batches of 3.5 g for 30 minutes. The resulting product was then discharged, washed and dried. The flakes have a metallic grey appearance and are stable in air, water and mild HCl. They are also highly magnetic. EDS analysis of the flakes suggest the presence of Al and Si in the mainly Fe coating matrix.

Example 7: FeMoW on Glass Flakes

Fe 18 wt %, Mo74 wt % and W 8 wt %.

$FeCl_3$: 183 mg, $MoCl_5$: 791 mg and $WCl_6$: 65 mg mixed with 1 g $AlCl_3$.

200 mg of Ecka Al powder (4 microns) mixed with 1 g $AlCl_3$.

The starting reactants were mixed with 5 g of glass flakes (average diameter of 200 microns and a thickness of 1.6 microns). The resulting mixture was heated in a rotating quartz tube at 575° C. in batches of 2 g for 20 minutes. The resulting product was discharged, and then washed and dried. The powder has a dark metallic appearance. XRD trace for the product is in FIG. 4.

Example 8: FeMoW on Carbon Fibres

Fe 18 wt %, Mo74 wt % and W 8 wt %.

$FeCl_3$: 183 mg, $MoCl_5$: 791 mg and $WCl_6$: 65 mg mixed with 1 g $AlCl_3$.

200 mg of Ecka Al powder (4 microns) mixed with 1 g $AlCl_3$.

The starting reactants were mixed with 2.5 g of carbon fibres cut to 1 cm length. The resulting mixture was heated in a rotating quartz tube at 800° C. 30 minutes. The resulting product was discharged, and then washed and dried.

Example 9: CuZn on Coarse Iron Powder 104 mg of $ZnCl_2$+318 mg of $CuCl_3$ mixed with 1 g $AlCl_3$.

168 mg of Ecka A/powder (4 microns) mixed with 1 g $AlCl_3$.

The starting reactants were mixed with 5 g of stainless steel powder (mean particle size 210 microns). The resulting mixture was heated in a rotating quartz tube at 600° C. for 20 minutes. The resulting product was discharged, and then washed and dried. SEM analysis suggests the powder is thoroughly coated with Cu—Zn.

The present method may be used for production of coating or compounds of various compositions based on Zn, Sn, Ag, Co, V, Ni, Cr, Fe, Cu, Pt, Pd, Ta, Nb, Rh, Ru, Mo, Os, Re and W including compounds of pure metal, oxides, nitrides of other non-inert elements as described above. Modifications, variations, products and use of said products as would be apparent to a skilled addressee are deemed to be within the scope of the present invention.

In the claims which follow and in the preceding description of embodiments, except where the context requires otherwise due to express language or necessary implication, the word "comprise" and variations such as "comprises" or "comprising" are used in an inclusive sense, to specify the presence of the stated features but not to preclude the presence or addition of further features in various embodiments of the invention.

It will be understood to persons skilled in the art of the invention that many modifications may be made without departing from the spirit and scope of the invention, in particular it will be apparent that certain features of embodiments of the invention can be employed to form further embodiments.

The invention claimed is:

1. A method for depositing metallic coatings on a particulate substrate, including:

a) mixing the particulate substrate with a solid precursor powder comprising a metal chloride/sub-chloride selected from one or more of $ZnCl_2$, $SnCl_2$, AgCl, $CoCl_2$, $VC_{(2,3)}$, $NiCl_2$, $CrCl_{(2,3)}$, $FeCl_{(2,3)}$, $CuCl_{(1,2)}$, $PtCl_{(4,3,2)}$, $PdCl_2$, $TaCl_{(4,5)}$, $NbCl_5$, $RhCl_3$, $RuCl_3$, $MoCl_5$, $OsCl_{(2,3,4)}$, $ReCl_3$ and a solid Al reducing agent to form a mixture; and b) heating the mixture to concurrently reduce the solid precursor powder in solid form and produce the metallic coating on said particulate substrate.

2. The method for forming a coating on a substrate according to claim 1, comprising:

immersing the particulate substrate being a substrate powder in a reactant mixture comprising the solid precursor powder and the solid Al reducing agent and any coating additives, and heating the resulting mixture at temperatures between 400° C. and 800° C. to induce reactions between a surface of the substrate powder and the reactant mixture and form the metallic coating on the substrate; and condensing by-products away from a reaction zone, where the reaction between the surface of the substrate and said reaction mixture takes place; and condensing unreacted metal chlorides and returning them to the reaction zone; and separating the coated substrate from residual un-reacted materials.

3. The method according to claim 1 for depositing metallic coatings on particulate substrates further comprising:

reducing one or more said metal chlorides/sub-chlorides with Al powder in the presence of the particulate substrate at temperatures between $T_0$ above 160° C. and $T_{max}$ to produce intermediates comprising metallic $M_c$-based species in a nanopowder form;

continuing heating and stirring of the reactants to induce physical or chemical reactions between the $M_c$-Al species and the substrate and cause a coating to form on the surface of the substrate; and $T_{max}$ is below 900° C.; and condensing by-products including aluminium chlorides away from the reactants; and separating the coated substrate from residual un-reacted materials.

4. The method according to claim 1 for depositing metallic coatings on a particulate substrate further comprising:

reacting metal chlorides with the substrate at temperatures below $T_{max}$ to form a coating on the substrate surface; and the coating comprises a metallic coating deposited on the substrate surface or a metallic skin obtained by chemically incorporating metallic elements into the substrate surface; and $T_{max}$ is below 900° C.; and condensing by-products away from the reactants.

5. The method as claimed in claim 1, wherein processing is carried out under inert gas.

6. The method as claimed in claim 1, wherein the coating metal includes one or more of Zn, Sn, Ag, Co, V, Ni, Cr, Fe, Cu, Pt, Pd, Ta, Nb, Rh, Ru, Mo, Os, Re and W, and wherein reactions between the coating metal chlorides/sub-chlorides and Al are exothermic.

7. The method according to claim 6, wherein the metal chlorides/sub-chlorides are mixed with $AlCl_3$ before reacting with the substrate, and wherein the amount of $AlCl_3$ is between 10 wt % and 500 wt % of the amount of the substrate.

8. The method according to claim 1, wherein the reducing Al agent is mixed with $AlCl_3$ before mixing with the substrate and the metal chlorides, and wherein the amount of $AlCl_3$ is between 10 wt % 0 and 500 wt % of the amount of the substrate.

9. The method as claimed in claim 1, wherein the substrate is in the form of:

i transition metal alloys and compounds including oxides, nitrides, carbides, and borides, or ii glass, glass flakes, glass beads, quartz, borosilicate, soda-glass, silicon nitride, mica flakes, talc powder, or iii graphite powder, graphite flakes, carbon fibre; or iv a mixture thereof.

10. The method according to claim 9, wherein the weight ratio of solid metal chlorides to substrate is between 0.01 and 0.5.

11. The method according to claim 9, wherein the substrate includes silicon based chemicals and the coating includes metal silicides.

12. The method according to claim 11, wherein the substrate includes a borosilicate substrate and where $T_{max}$ is below 650° C.

13. The method according to claim 11, wherein the substrate includes a soda-glass substrate and where $T_{max}$ is below 650° C.

14. The method according to claim 9, wherein the substrate is based on carbon and made of powder, beads, flakes or fibre and the coating includes metal carbides.

15. The method according to claim 1, wherein the method is carried out at a pressure between 0.0001 bar and 1.1 bar.

16. The method according to claim 1, wherein precursor materials which escape the reaction zone are condensed and returned to the reaction zone for recycling.

17. The method according to claim 6, wherein the method includes the additional step of reacting the coated substrates with a reactive gas.

18. The method according to claim 2, wherein the coating additives include boron, carbon, oxygen or nitrogen and the products comprise a substrate coated with metal borides, metal carbide, metal oxide or metal nitride.

19. The method according to claim 9, wherein the coating on the coated substrate products include Al at levels between 0 wt % and 50 wt %.

20. The method according to claim 17, wherein the reactive gas includes a reactive element from the group of oxygen, nitrogen, carbon and boron.

21. The method according to claim 1, wherein heating the mixture is conducted at temperatures below 700° C.

* * * * *